US009033198B2

(12) United States Patent
Escherich

(10) Patent No.: US 9,033,198 B2
(45) Date of Patent: May 19, 2015

(54) MAGNETIC BIT-HOLDER BRACELET DEVICE

(76) Inventor: Fabien Escherich, Gryon (CH)

( * ) Notice: Subject to any disclaimer, the term of this patent is extended or adjusted under 35 U.S.C. 154(b) by 0 days.

(21) Appl. No.: 14/240,447

(22) PCT Filed: Aug. 22, 2012

(86) PCT No.: PCT/FR2012/051920
§ 371 (c)(1),
(2), (4) Date: May 27, 2014

(87) PCT Pub. No.: WO2013/026988
PCT Pub. Date: Feb. 28, 2013

(65) Prior Publication Data

US 2014/0299640 A1 Oct. 9, 2014

(30) Foreign Application Priority Data

Aug. 23, 2011 (FR) ..... 11 57480

(51) Int. Cl.
*A45F 5/00* (2006.01)
*B25H 3/00* (2006.01)

(52) U.S. Cl.
CPC ..... *B25H 3/003* (2013.01); *A45F 2005/008* (2013.01); *A45F 5/00* (2013.01)

(58) Field of Classification Search
CPC ..... B25H 3/003; A45F 5/00
USPC ..... 224/183, 219, 221, 251; 206/350; D3/229
See application file for complete search history.

(56) References Cited

U.S. PATENT DOCUMENTS

| | | | | |
|---|---|---|---|---|
| 2,452,400 | A * | 10/1948 | Stevens | 224/183 |
| 5,868,251 | A | 2/1999 | Lin | |
| 6,702,112 | B1 | 3/2004 | Henderson | |
| 6,910,578 | B2 * | 6/2005 | Stern | 206/379 |
| 7,270,289 | B2 * | 9/2007 | Kish | 242/280 |
| 2004/0055917 | A1 | 3/2004 | Stern | |
| 2004/0206649 | A1 | 10/2004 | Chen | |
| 2005/0230442 | A1 | 10/2005 | Birdwell et al. | |

FOREIGN PATENT DOCUMENTS

| | | | |
|---|---|---|---|
| DE | 84 17 648 | U1 | 9/1984 |
| DE | 296 13 153 | U1 | 9/1996 |
| DE | 20 2009 004849 | U1 | 8/2009 |

OTHER PUBLICATIONS

International Search Report issued in corresponding application No. PCT/FR2012/051920 mailed Feb. 6, 2013.

* cited by examiner

*Primary Examiner* — Justin Larson
(74) *Attorney, Agent, or Firm* — Carter, DeLuca, Farrell & Schmidt, LLP

(57) ABSTRACT

A magnetic bit-holder bracelet device intended to be worn by a user on his wrist and to hold screwdriver or similar bits includes a bracelet made of plastic, that can be attached or fixed to the wrist, incorporating, over all or part of its circumference, a row of pockets and holder cavities built into the bracelet, each formed by one of the pockets or attached to the bracelet, each in one of the pockets and able to house axially, and removably, one of the bits, the blind end of each holder cavity having a magnet able to apply a magnetic force of attraction to the bit concerned in order to retain and hold it in the relevant holding cavity.

11 Claims, 7 Drawing Sheets

MAGNETIC BIT-HOLDER BRACELET DEVICE

Figure 1:
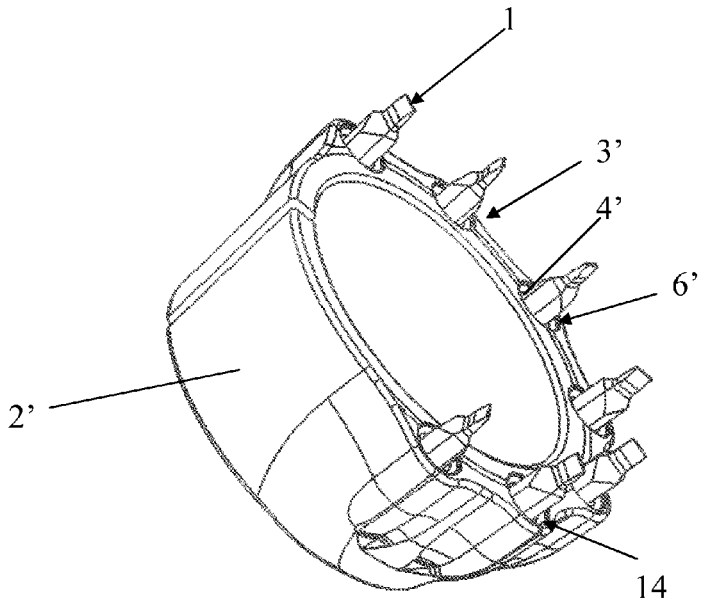

The present invention concerns the field of devices which are used to hold tools, more particularly screwdriver bits or other similar tools, and which are intended to be worn on a user's body, and it relates to a magnetic bit-holder bracelet device.

It is known that when working on construction sites, amateur or professional users commonly have to grab screwdriver bits to replace the bit of their electrical screwdriver or to put such bits in different places for storing them and grabbing them later.

However, it often happens that these bits are hidden under rubble or wood chips, and the users have great difficulty finding them again, which entails a loss of time, or they fail to locate them again.

Moreover, when the bits are stored in a storage box, they are difficult to access when the box is located at a site far from the user. In addition, when these bits are put loosely in the user's pocket, selecting and grabbing the bits is not easy because they are not visible and are difficult to access.

On the other hand, the user often has to work under special and restricting conditions, for example, in a manhole, or lying down or in more acrobatic positions, at height, on scaffolding or in a rappelling position suspended from a wall inside or outside of a building. Such work conditions make it even more difficult to hold or grab bits, regardless of whether they are in the user's pocket or in a box placed nearby. In addition, the bits frequently fall from their grip and become lost.

To solve these problems, bit-holder boxes have been developed that can be attached to the belt of the users.

However, these boxes need to be opened to gain access to the bits and, since they are attached to the waist of the user, which is often covered by clothing, they do not make it possible to easily select and grab the bits, particularly under special or restricting work conditions.

Other devices such as arm bands that can be attached around the user's arm include an outer face, forming the back side of an inner face intended to come in contact with the said arm, and comprising housings formed by flexible tabs or pouches each of which is suitable for holding a bit or the like.

However, the bits that are placed in such housings delimited by flexible walls or walls having a small thickness are not protected against impacts or crushing so that they are often damaged or ruined. In addition, these housings are designed to hold the bits tightly to prevent them from falling out, but the squeezing force opposes easy and rapid removal or extraction of the bit. On the other hand, if the squeezing force is reduced, the removal of each bit can then occur more easily and more rapidly, but the bit is no longer held or retained effectively in its housing, which has the effect that the bit comes out of the housing and falls from the arm band when the latter is in an upside down position due to special work circumstances of the user.

The purpose of the present invention is to overcome these disadvantages by proposing a magnetic bit-holder bracelet device, which is intended to be worn by the user on his wrist and to hold screwdriver bits or the like, conferring great visibility to the bits and allowing easy and rapid grabbing of the latter with effective retention and holding, regardless of the work and movement circumstances of the user.

To this effect, the magnetic bit-holder bracelet device according to the present invention, which is intended to be worn by a user on his wrist and to hold screwdriver bits or similar tools, includes, on the one hand, a bracelet made of a polymer material, preferably a plastic, and more preferably a natural or synthetic rubber, suitable for being attached or fastened to said wrist by having an overall cylindrical or annular shape whose axis of revolution substantially coincides with the axis of the wrist, said bracelet integrating, over all or part of its circumference, a row of pockets, and, on the other hand, holding cavities having an overall cylindrical and/or conical shape, which are integrated in said bracelet, each formed by one of said pockets or, if applicable, mounted in said bracelet each in one of said pockets, each holding cavity being provided with a bottom and with a receiving opening opposite said bottom, and being suitable for receiving axially, in a removable manner, one of said bits so that said bit abuts with one of its free ends against the bottom of said holding cavity, while its other free end projects beyond said holding cavity to allow said bit to be grabbed, and is characterized essentially in that the bottom of each holding cavity includes a magnet suitable for applying a magnetic force of attraction on the bit in question in order to retain and hold it in the holding cavity in question, and in that, in the overall cylindrical or annular state of the bracelet, either each holding cavity extends axially along a generating line of a conical surface having an axis that substantially coincides with the axis of revolution of the bracelet, so as to position each bit obliquely with respect to said axis of revolution with a view to facilitating its being grabbed, or the holding cavities extend substantially parallel to the axis of revolution of the bracelet.

Figure 2:
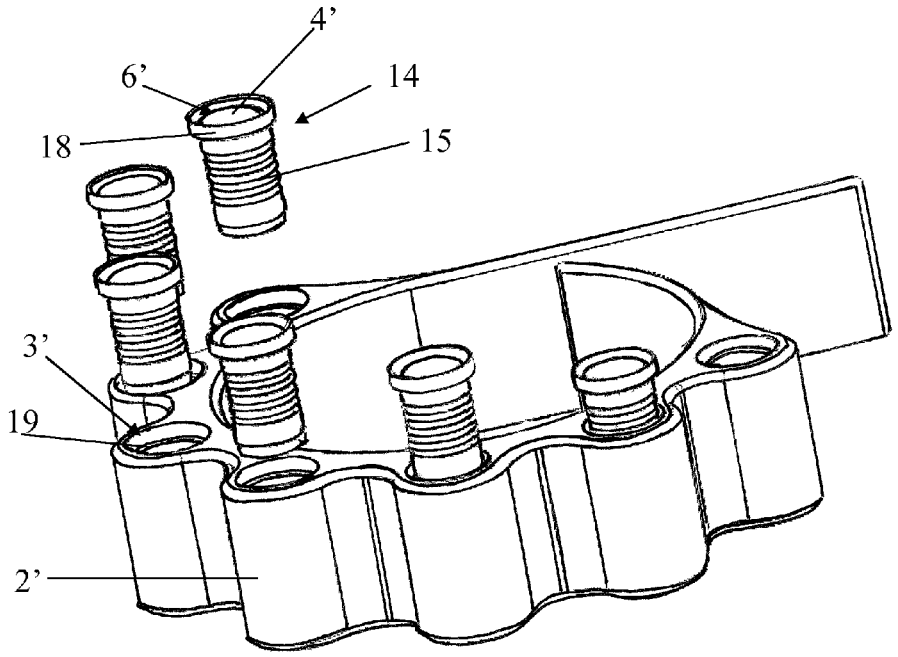
Figure 3:
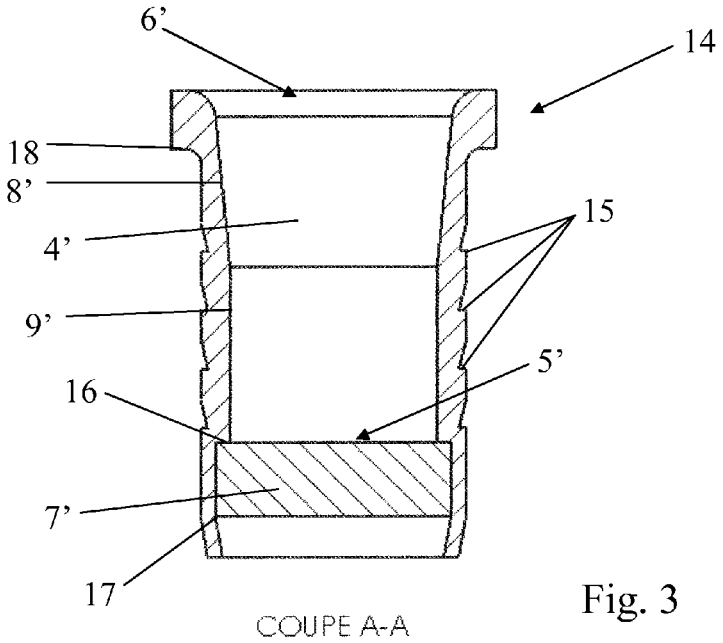
Figure 4:
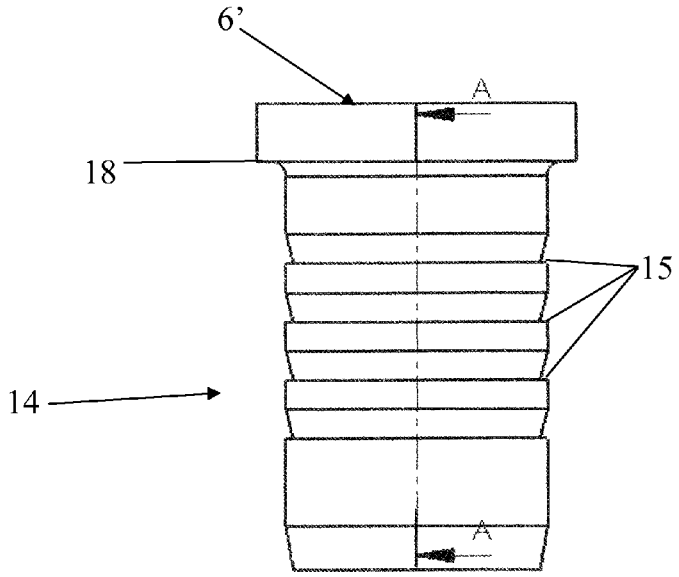
Figure 5:
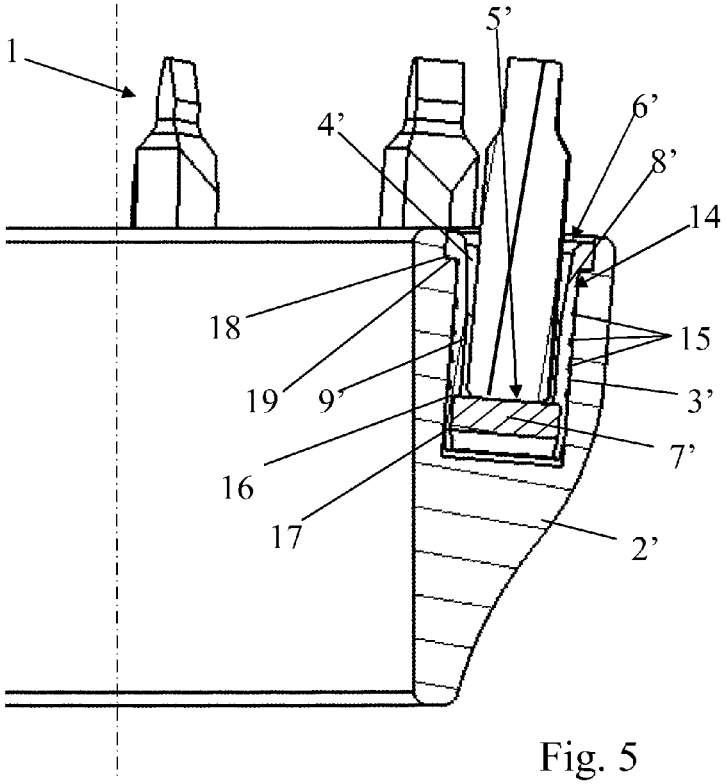
Figure 6:
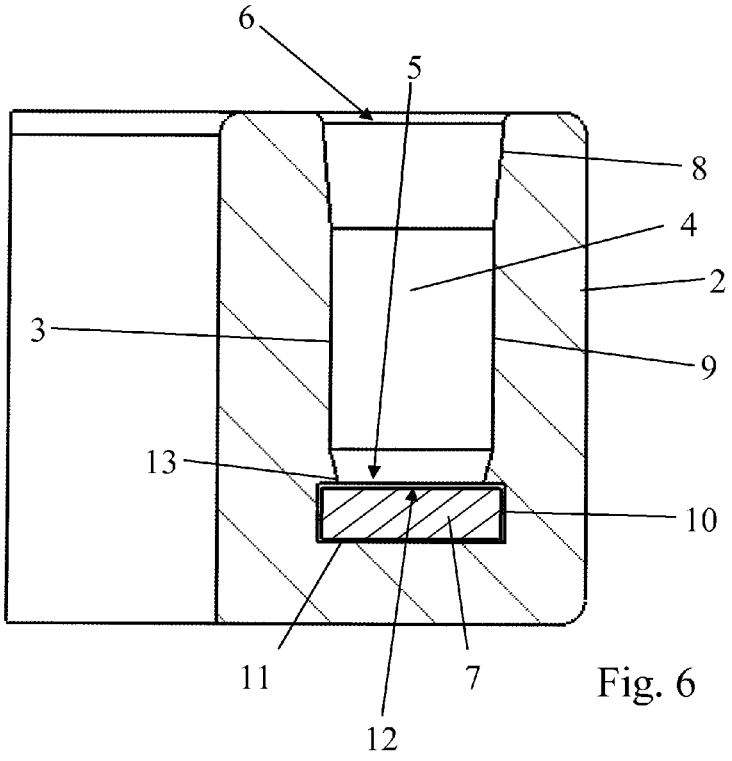
Figure 7:
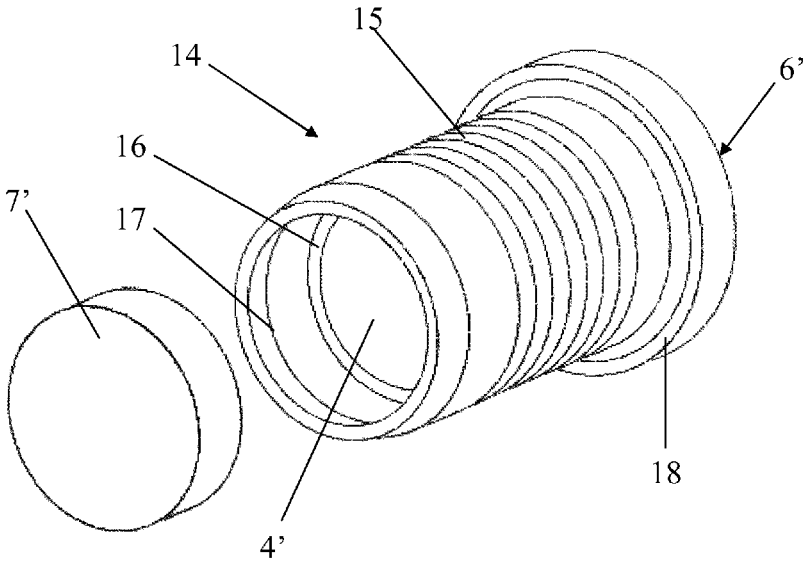
Figure 8:
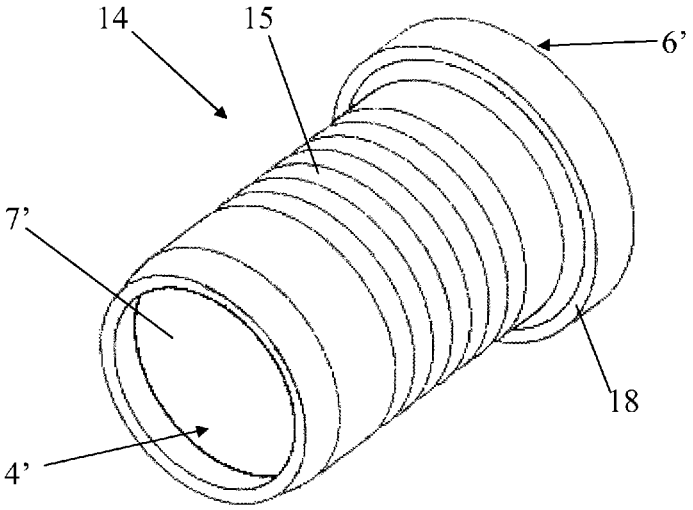
Figure 9:
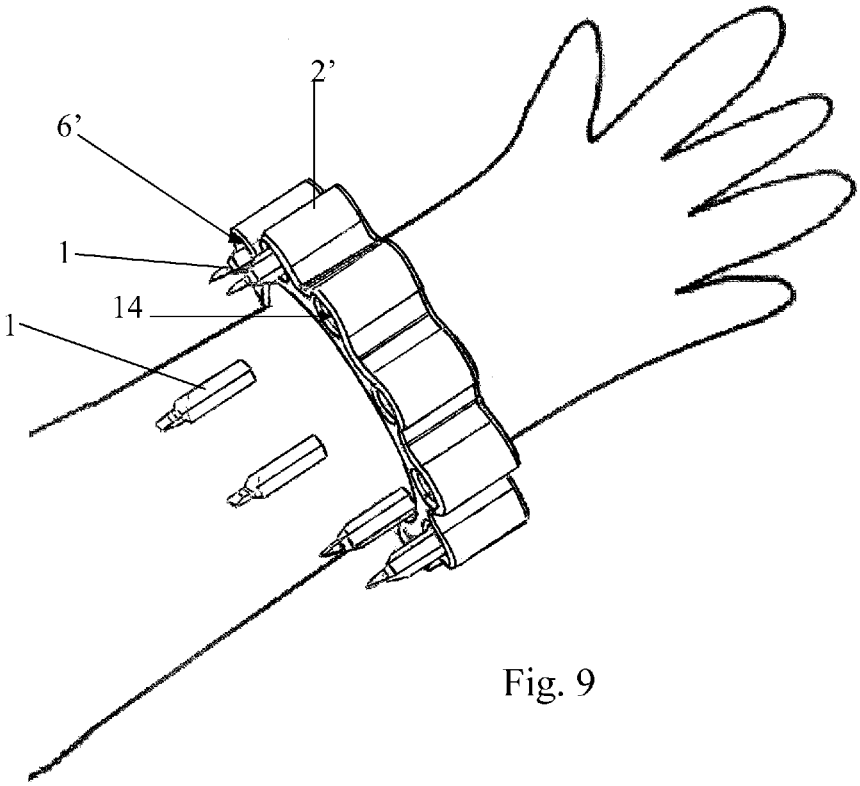

The invention will be better understood based on the following description, which refers to a preferred embodiment given as a nonlimiting example and explained in reference to the appended diagrammatic drawings, in which:

FIG. 1 shows a perspective view of a bracelet device according to the present invention in a preferred embodiment, wherein the holding cavities are mounted in the bracelet which permanently has an overall cylindrical or annular shape, in a configuration where the bits are inserted in the bracelet, FIG. 2 shows a perspective view of a device according to the present invention, in a preferred embodiment, wherein the holding cavities are mounted in the bracelet consisting of a band suitable for being attached to the wrist by having an overall cylindrical or annular shape, in a phase of introduction of sockets into the pockets of the bracelet which are provided for this purpose, FIG. 3 shows a view in longitudinal section of a socket represented in FIG. 2, FIG. 4 shows a side view of the socket represented in FIG. 3, FIG. 5 shows a view in partial cross section of the device represented in FIG. 1, FIG. 6 shows a view in cross section of a holding cavity of a device according to the present invention in a particular embodiment, wherein the cavities are integrated in the bracelet, FIG. 7 shows a perspective view of a socket in the phase of introduction of a magnet into the latter, FIG. 8 shows a perspective view of the socket represented in FIG. 7 with the magnet fastened mechanically by crimping in said socket, FIG. 9 shows the device represented in FIG. 2 in the state where it is fastened to a user's wrist and in a phase of insertion of the bits.

Figure 10:
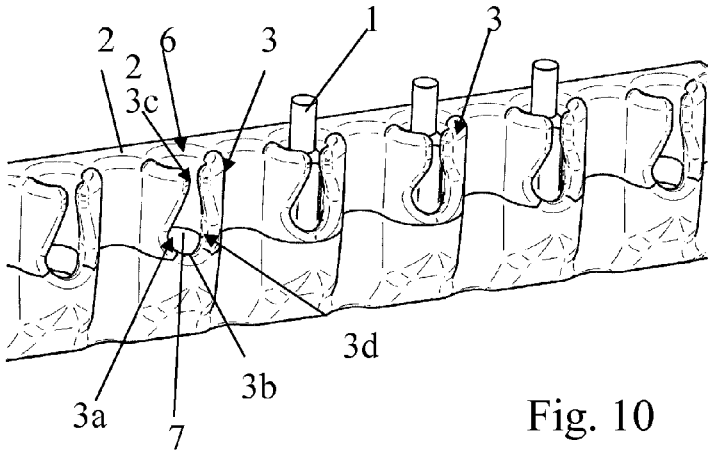
Figure 11:
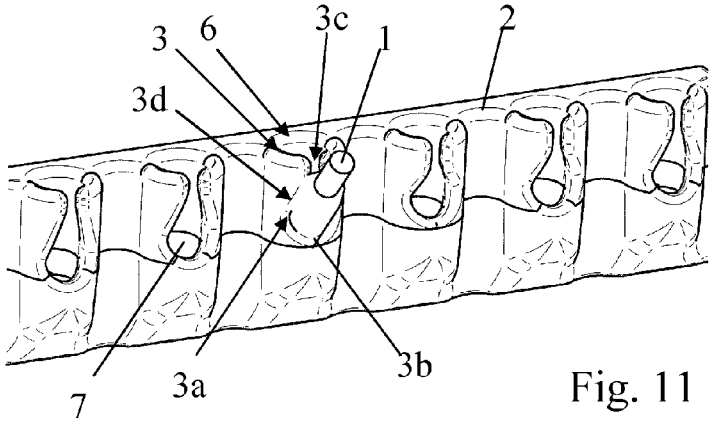
Figure 12:
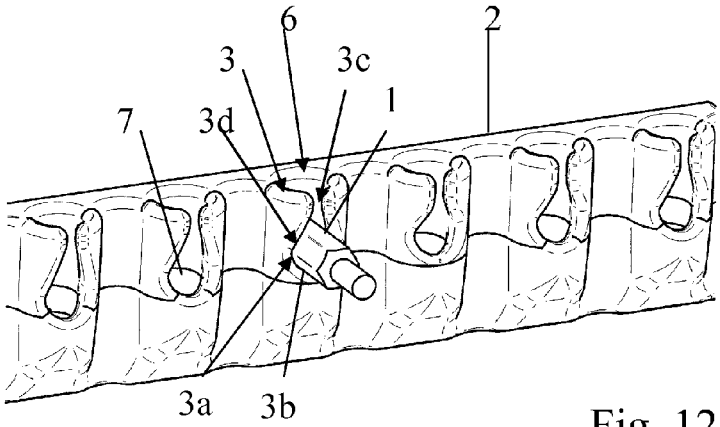
Figure 15:
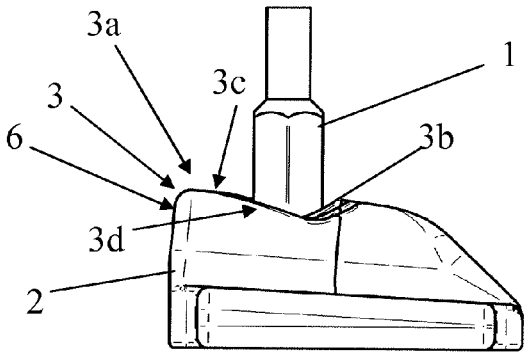
Figure 14:
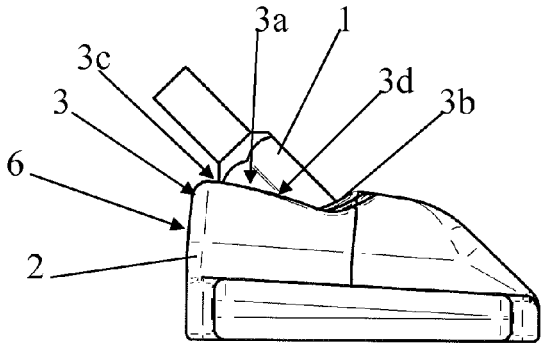
Figure 13:
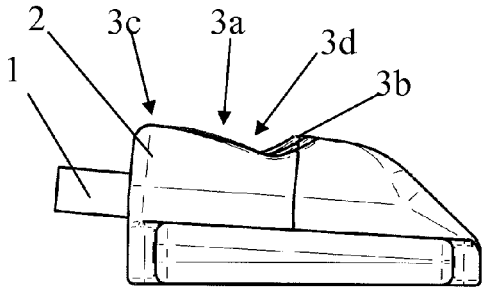

FIG. 10 shows the device according to the present invention in another embodiment in the state of insertion of three bits into the pockets integrated in the bracelet and each including a system for opening and lateral extraction, FIG. 11 shows the device represented in FIG. 10 with a single pocket holding a bit and in the state where said bit is tilted in said pocket with a view to its transverse extraction, FIG. 12 shows the device represented in FIG. 11, in the tilted state of the bit in the position for transverse extraction with a view to its being grabbed for its transverse extraction, FIG. 13 shows a side view of the pocket of the device represented in FIG. 11 in which the bit is inserted axially and longitudinally, FIG. 14 shows the bit represented in FIG. 13 in the tilted state, FIG. 15 shows the bit represented in FIG. 13 in the state tilted in the position for transverse extraction with a view to its being grabbed for its transverse extraction.

The figures show a magnetic bit-holder bracelet device intended to be worn by a user on his wrist and to hold screwdriver bits 1 or the like.

According to the present invention, such a device includes, on the one hand, a bracelet 2 or 2' made of a polymer material, preferably a plastic, more preferably a natural or synthetic rubber, suitable for being attached or fastened to said wrist, having an overall cylindrical or annular shape with an axis of revolution that substantially coincides with the axis of the wrist or of the forearm of the user, said bracelet 2 or 2' integrating, over all or part of its circumference, a row of pockets 3 or 3', and, on the other hand, holding cavities 4 or 4' having an overall cylindrical and/or conical shape.

In a preferred embodiment of the present invention, the holding cavities 4' can be mounted in said bracelet 2', each in one of the pockets 3' adapted for this purpose.

In a particular embodiment of the present invention, the holding cavities 3 can be integrated in the bracelet 2, each formed by one of said pockets 3, in particular integrally molded with the bracelet 2.

In addition, still according to the present invention, each holding cavity 4 or 4' is provided with a bottom 5 or 5' and with a receiving opening 6 or 6' opposite said bottom 5 or 5' (FIGS. 3 and 6) and it is suitable for receiving axially, in a removable manner, a bit 1 in such a manner that said bit abuts, with one of its free ends, against the bottom 5 or 5' (FIG. 5) of the holding cavity 4 or 4' while projecting beyond the latter with its other free end to allow the bit 1 to be grabbed.

Still according to the present invention, as one can see in FIGS. 3, 5, 6, 10, 11 and 12, the bottom 5 or 5' of each holding cavity 4 or 4' includes a magnet 7 or 7' suitable for applying a magnetic force of attraction to the bit 1 in question, more particularly to its free end opposite the end that projects beyond said cavity, in order to retain and hold it effectively in the latter.

Preferably, in the overall cylindrical or annular state of the bracelet 2, each holding cavity 4 or 4' can extend axially along a generating line of a conical surface having an axis which substantially coincides with the axis of revolution of the bracelet 2 or 2', so as to position each bit 1 obliquely with respect to said axis of revolution with a view to facilitating its being grabbed (FIGS. 1, 5, 10, 11, 12, 13, 14 and 15). It should be understood that the conical surface is preferably common to all of the holding cavities 4 or 4'.

The oblique position of each bit 1 with respect to the axis of revolution of the bracelet 2, when the latter is worn, or with respect to the axis of the wrist, thus makes it possible to disengage and separate the free end portion of each bit 1 from the wrist, or from fabric that covers the latter and is enclosed by said bracelet 2, facilitating inasmuch the grabbing of the bits with a view to extracting them from the holding cavity 4 or 4' which holds them or with a view to inserting them in one of said cavities.

In a variant, the holding cavities 4 or 4' can extend substantially parallel to the axis of revolution of the bracelet 2, in the overall cylindrical or annular state of the latter (FIGS. 2, 9 and 6).

The bracelet 2 or 2' comprises an outer side and an inner side which forms the back side of said outer side and which is intended to be in contact with the wrist; each holding cavity 4 or 4' can extend over said outer side (FIGS. 1, 2, 5, 6, 9, 10, 11, 12, 13, 14 and 15).

In addition, the portions of the bracelet 1 that connect two pockets 3 or 3' or two holding cavities 4 or 4' that are adjacent can have a smaller thickness. Moreover, such connecting portions can advantageously be resiliently deformable so as to allow the user to be able to slip on the bracelet 3 directly around the wrist by simply passing the hand through the resiliently deformable bracelet 2 which adjusts automatically to the wrist.

Thus, the bracelet 2 can constitute a first embodiment that is resiliently deformable while having a permanent overall annular or cylindrical shape (FIG. 1). Such a bracelet can then be slipped on and removed as desired.

In another embodiment, as can be seen in FIG. 2, the bracelet 2 can consist of a band that is suitable for being fastened or attached to the wrist while having an overall annular or cylindrical shape, in particular by connecting its free ends provided for this purpose. Such a connection, not shown, can be implemented by any known type of attachment, and preferably by means of a removable linking means known under the name of the registered trademark "VELCRO." In this embodiment, the bracelet can also be provided to be resiliently deformable, in particular so as to make it possible, in a first step, to adjust and fit the bracelet 2, which in that case has a range of adjustment, around and to the wrist which may be small or large, and then, to subsequently slip the bracelet on and remove it as desired as in the preceding case.

Naturally, regardless of which one of these embodiments is used, such a bracelet 2 can be provided to be resiliently deformable over the entire circumference or only partially, more particularly at the site of the portions connecting two pockets 3 or 3', as seen above and/or at the site of one or more areas located outside of the row of said pockets.

The bracelet 2 according to the present invention can preferably be made from a rubber material, more preferably from a high-quality hypoallergenic material, so as to avoid any allergic reaction due, for example, to perspiration during intense work or when working in high heat.

In a first embodiment, not shown, of each holding cavity 4' or 4', said cavity can have an overall conical shape that widens toward the receiving opening 6 or 6' of said cavity.

In a second embodiment of each holding cavity 4 or 4', said cavity can consist of a first section 8 or 8' integrating the receiving opening 6 or 6' of said cavity and having an overall conical shape widens toward the receiving opening 6 or 6' of said cavity and of a second section 9 or 9' having an overall cylindrical shape and axially extending said first section 8 or 8' toward the bottom 5 or 5' of said cavity (see in particular FIGS. 3, 5 and 6).

Due to the conicity of each holding cavity 4 or 4', at least in its portion integrating the receiving opening 6 or 6', these two embodiments make it possible to facilitate the insertion and in particular the extraction of the bit 1 in question. Indeed, at the time of the insertion of a bit 1 or, more particularly, its extraction from a holding cavity 4 or 4', the user is naturally led to incline naturally said bit 1 with respect to the axis of said cavity, which has the effect of immobilizing the bit 1 due to friction of the latter against the inner edge of the receiving opening 6 or 6'. Such conicity then allows the extraction or insertion of the bit 1 at a slant, limiting friction between the latter and the edge of the receiving opening 6 or 6'.

To further facilitate the insertion and the extraction of each bit 1 in one of the holding cavities 4 or 4', the present invention can provide that the internal edge of each receiving opening 6 or 6' is rounded. The present invention can also provide that said internal edge is rounded in the case where the holding cavity 4 or 4' is entirely cylindrical, that is without conicity.

In a preferred embodiment of each magnet 7 or 7', the latter can be in the shape of a pellet or platelet, which is preferably round, and it can be provided to be fastened in one of the holding cavities 4 or 4', extending substantially perpendicularly to the axis of the latter so as to form, at least partially, the bottom 5 or 5' (FIGS. 3, 5, 6, 7, 8, 10, 11 and 12).

In a particular embodiment of the present invention, as can be seen in FIG. 6, each holding cavity 4 is integrated in the bracelet 2 by being formed by one of the pockets 3, that is to say each pocket 3 consists of a holding cavity 4, and each magnet 7, preferably in the form of pellet or round platelet, can be fastened in the corresponding holding cavity 4 by being nested at the bottom of the latter in a housing 10 comprising a bottom 11 and an inlet opening 12 delimited by a preferably circular re-entrant edge 13, which may be continuous or not, produced in the internal wall of said holding cavity 4. The re-entrant edge 13 is resiliently deformable so as to allow the passage of the magnet 7 which is then immobilized axially in the housing 10 between the bottom 11 and the re-entrant edge 13 of the latter.

In an embodiment variant, which is not shown in the appended drawings, of the holding and of the axial immobilization of each magnet 7 in a holding cavity 4 integrated in one of the pockets 3, each magnet 7 can be immobilized between a first shoulder similar, for example, to the above-mentioned re-entrant edge 13, and between a second shoulder produced in the internal wall of the corresponding pocket 3, recessed with respect to the first shoulder.

Thus, each holding cavity whose walls are made of plastic having a certain thickness offers effective protection of the bit 1 inserted in said cavity.

In the case where each holding cavity 4 is integrated in the bracelet 2 by being formed by one of the pockets 3, at least one of the integrated pockets 3 can include in its lateral wall, on the outer side of the bracelet 2, a system for opening and lateral extraction 3*a*, 3*b*, 3*c*, 3*d* (FIGS. 10, 11, 12, 13, 14 and 15) making it possible to move, if necessary, by pivoting or tilting, the bit 1 inserted in said pocket 3 (FIGS. 11 and 14) from its position of axial or longitudinal insertion (FIGS. 10 and 13) in said pocket to a position, or position for transverse extraction (FIGS. 12 and 15), which is substantially perpendicular with respect to the axis of said pocket 3.

The position for transverse extraction has the effect essentially of freeing a surface for grabbing the bit 1, which is larger than that of the bit 1 in the state of axial or longitudinal insertion, in order to improve the grabbing of the bit 1 to facilitate its extraction and/or to release the bit 1 from the magnet 7 of said pocket (3) in order to further facilitate its extraction.

More particularly, such a position of transverse extraction can allow the operator to extract the bits 1 in all situations and particularly in special situations where said operator cannot apply or can apply only with difficulty, in the state of longitudinal insertion or extraction of the bits 1, a sufficient grabbing and extracting force to the latter bits, to oppose the forces holding and retaining the bits 1 in their respective pockets 3. These forces can be generated, for example, by the magnetic attraction of the magnet 7 on the bits 1 or by resilient squeezing forces or friction forces of the inner walls of the pockets 3 on the bits 1. Such special situations are encountered, for example, when the fingers of the operator are covered with a film of a greasy or slippery material eliminating any possible adhesion of his fingers to the bits 1 capable of opposing said holding and retaining forces and in particular the forces of retention by magnetic attraction that are applied by the magnets 7 to the corresponding bits 1.

In a preferred embodiment of the system for opening and lateral extraction 3*a*, 3*b*, 3*c*, 3*d*, said system can consist of a cutout or an opening 3*a* produced longitudinally, on the outer side of the bracelet 2, in the lateral wall of the pocket 3 in question, from the edge of the receiving opening 6, by opening on the latter, toward the bottom 5 of said pocket 3. It is preferable for the cutout 3*a* to comprise a bottom 3*b* which is set back from the magnet 7.

In addition, each cutout 3*a* can preferably have a straight, round or conical shape or a combination of one or another of said shapes (FIGS. 10, 11 and 12), for example, by having an overall profile in the shape of a drop of water.

As can be seen in FIGS. 10, 11 and 12, each cutout 3*a* preferably having an overall profile in the shape of a drop of water can comprise successively, from the edge of the receiving opening 6, a slot or narrow part 3*c*, which is preferably straight or conical, forming a holding and guiding portion for the bit 1 in question in the cutout 3*a* as it is being tilted (FIG. 11), then a preferably round or conical broadened portion forming an opening for lateral extraction 3*d* which is suitable for holding the bit 1 in the tilted state so as to position it in the position for transverse extraction (FIG. 12).

It is understood that each bit 1, in the tilted state or in the position for transverse extraction, can pass through the lateral extraction opening 3*d* of the pocket 3 holding it by extending more particularly substantially parallel to the axis of said opening for lateral extraction (FIG. 12).

In addition, the integrated lateral wall of each pocket 3 can preferably be flexible or resiliently deformable so that the two edges or lips of each cutout 3*a* can be flexible or resiliently deformable.

The bottom 3*d* of the cutout 3*a* which is set back from the magnet 7 of the corresponding pocket 3 can form a pivot stop, for example, in the form of a shoulder, around which stop or shoulder the bit 1 in question can pivot or tilt. Such a pivot stop which is set back from the magnet 7 can have the effect of releasing the bit 1 from the magnet 7, that is of separating the bit 1 from the magnet 7 or reducing the effect of the force of magnetic attraction of the latter on the bit 1.

Moreover, it should be understood that in the tilted state or the state of transverse extraction, each bit 1 that is in contact with the inner wall of the latter has a reduced contact area with the pocket 3, freeing inasmuch its grabbing surface and reducing inasmuch the friction forces between the bit 1 and the inner wall of the pocket, which facilitates its extraction.

The tilting of each bit 1 in question can be carried out by the operator, for example, by means of one of his fingers, by simply applying to the end of the bit 1 which, in the state of axial or longitudinal insertion of the latter, projects from the pocket 3, a force toward the outside of the bracelet 2 and toward the system for opening and for lateral extraction.

Moreover, the particular shape of the cutout in the form of a drop of water having the narrow part 3*c* delimited by the resiliently deformable edges makes it possible to insert the bit 1, as it is being tilted, into the narrow part 3*c* (FIG. 11) under the control of one of his fingers, and then, due to the effect of the resilient pressure of the edges of the narrow part 3*c*, on the portion of bit 1 that passes through the latter, the bit 1 can be guided and tilted automatically, by a propulsion effect, in the opening for lateral extraction 3*d* into the position for transverse extraction. Now, each bit 1 can automatically and without requiring any force assume a position that is transverse or substantially perpendicular with respect to axis of the corresponding pocket 3, after its insertion or its passage, during its tilting, into the narrow part 3*c* under the control one of the fingers of the operator.

The dimensions of each cutout 3*a* and in particular the dimensions of each opening for lateral extraction 3*d* can be substantially identical or less than those of the portions of the bits 1 passing through them to prevent them from falling, particularly when the bits 1 are released from the magnets 7 in the tilted state.

Such cutouts 3*a* also make it possible to create a window in the front face of each pocket 3 in question allowing the operator to be able to read the standard identification numbers engraved on the faces of the bits 1 which are either in their position of axial or longitudinal insertion in their respective pockets 3, or in their position for transverse extraction.

In the case where the holding cavities 3' are mounted in the bracelets 2, each one in one of the pockets 3' adapted for this purpose, the device according to the present invention can include, in addition, metal sockets 14 each of which can be introduced, in a removable manner, into one of said pockets 3' (FIGS. 1, 2, 5 and 9). Each socket 14 can be held firmly in the pocket 3' in question by means of removable fastening means 15, and the hollow portion of each socket 14 can form one of the holding cavities 4' of the bracelet 2' (FIGS. 3, 4, 5, 7 and 8).

It should be understood that, in this case, each holding cavity 4' can be formed by the hollow portion of the corresponding socket 14 which can be introduced and held firmly, in a removable manner, in one of the pockets 3' which is suitable for holding such a socket 14. More particularly, it should be noted that the dimensions of a pocket 3' in this case can preferably be greater than those of a pocket 3 forming a holding cavity 4 integrated in the bracelet 2 according to a particular embodiment, in such a manner that the integrated holding cavities 4 and the mounted holding cavities 4' have substantially identical dimensions suitable for holding a screwdriver bit 1 or the like known on the tool market.

In a preferred embodiment of the means for removable fastening 15, said means can consist of anchoring means, such as, for example, annular notches produced in the outer face of each socket 14, so as to allow the anchoring of each socket 14 by friction between said anchoring means and the internal wall of the pocket 3' in question.

Still in the preferred embodiment, as can be seen in FIGS. 3, 5, 7 and 8, each magnet 7' can be in the shape of a pellet or platelet, which is preferably round, and can be mechanically fastened in the socket 14 in question, extending substantially perpendicularly to the axis of said socket and forming, at least partially, the bottom 5' of the latter.

The fastening of each magnet 7' in the socket 14 in question can be produced, for example, by mechanical crimping of the socket 14 after introduction of the magnet 7 into the latter. Each magnet 7' can preferably be immobilized axially in the socket 14 between a first internal shoulder 16 and a second internal shoulder 17 of the socket 14. Each internal shoulder 16 or 17 can be produced by crimping or it can be produced in the internal wall of the corresponding socket 14 (FIGS. 7 and 8).

In a variant, not shown, each magnet 7' can be fastened, preferably by nesting, in the pocket 3' in question. More specifically, each magnet 7' can be fastened at the bottom of one of the pockets 3' in a housing provided for this purpose of the housing 10 type described above, and each socket 14, which may or may not have a bottom, can extend axially above said magnet 7. Thus, in the case where the sockets 14 were to include an integrated bottom, each magnet 7' could then be located, in the pocket 3', under the integrated bottom of the socket 14 in question and preferably in contact with or in the immediate vicinity of the latter, and be provided to apply a sufficient force of attraction through the integrated bottom to retain the bit 1 inserted in the socket 14. Thus, in this variant with sockets 14 including an integrated bottom, the bottom 5' of each holding cavity 3' includes the integrated bottom of the socket 14 and the magnet 7' located under the integrated bottom in contact with or in the immediate vicinity of the latter.

The removable fastening means 15 of each socket 14 can be provided in order to prevent the socket 14 in question from coming out of the pocket 3' holding it due to the effect of the traction applied by the user to the bit 1, for the purpose of its removal, said bit being magnetically fastened at the bottom of said socket.

Moreover, each socket 14 can be introduced and held in the pocket 3' in question so that the receiving opening 6' of each socket 14 is flush with or is slightly recessed with respect to the receiving opening of said pocket 3', this so that there is no visible portion of socket 14 that risks scratching an object such as glass or a piece of lacquered furniture during various work operations.

More specifically, each socket 14 can comprise an outer annular margin 18 and each pocket 3' can comprise an inner annular margin 19 so as to allow each socket 14 inserted into one of the pockets 3' to rest with its outer annular margin 18 against the inner annular margin 19 of said pocket 3' while positioning the receiving opening 6' of each socket 14 in a position that is recessed with respect to the receiving opening of the pocket 3'.

It should be understood that each mounted holding cavity 4' formed by the hollow portion of one of the sockets 12 can be made to be removable, which has the advantage of allowing the user to change the socket 14 when, in spite of the material and thickness of the walls of the pockets, one of the holding cavities 4' becomes damaged nevertheless due to crushing of or impact to the bracelet 2, or when one of the magnets 7' is damaged or broken as a result of such a impact or crushing.

The dimensions of the pockets 3' can be provided in such a manner that the sockets 14 can be retained effectively, notably by means of their anchoring means 15, but also in such a manner as to make it possible to extract a damaged socket 14, for example, by means of a tool of the pliers or screwdriver type.

It should also be noted that, according to the present invention, a pocket 3' can be adapted to receive a socket or bit whose dimensions are smaller, particularly in terms of the diameter, than the size of a socket. Moreover, it should be understood, that at the time of the withdrawal of a socket 14 from its pocket 3', the latter will naturally retract due to its resilience and, consequently, adapt automatically to the diameter, which is smaller, of the bit 1 inserted in said pocket.

It should be noted that such a device fastened around the wrist makes it possible for the operator to grab and extract the bits with a single hand, while the hand of the wrist around which the device is fastened can hold, for example, a tool, such as an electric screwdriver.

Naturally, the invention is not limited to the embodiments, forms and variants that have been described and represented in the appended drawings. Modifications remain possible, in particular with regard to the constitution of the various elements or by replacement with technical equivalents, without going beyond the scope of protection of the invention. For example, the bracelet of the device according to the present invention could also be provided, without going beyond the scope of the present invention, to be fastened around a support element having a shape similar or analogous to that of the wrist of a person, such as a scaffolding tube, for example, but in a non limiting manner.

The invention claimed is:

1. A magnetic bit-holder bracelet device intended to be worn by a user on his wrist and to hold screwdriver bits or similar tools, comprising:

a bracelet made of a polymer material, suitable for being attached or fastened to the wrist by having an overall cylindrical or annular shape whose axis of revolution substantially coincides with the axis of the wrist, wherein the bracelet integrates, over all or part of its circumference, a row of pockets; and holding cavities having an overall cylindrical and/or conical shape, which are integrated in the bracelet, each formed by one of the pockets, each holding cavity being provided with a bottom and with a receiving opening opposite the bottom and being suitable for receiving axially, in a removable manner, one of the bits so that the bit abuts with one of its free ends against the bottom of the holding cavity, while its other free end projects beyond the holding cavity to allow the bit to be grabbed, the bottom of each holding cavity including a magnet suitable for applying a magnetic force of attraction to the bit in order to retain it and hold it in the holding cavity, and wherein that, in the overall cylindrical or annular state of the bracelet, either each holding cavity extends axially along a generating line of a conical surface having an axis that substantially coincides with the axis of revolution of the bracelet, so as to position each bit obliquely with respect to the axis of revolution with a view to facilitating its being grabbed, or the holding cavities extend substantially parallel to the axis of revolution of the bracelet, wherein at least one of the pockets has a lateral wall that includes, on the outer side of the bracelet, a system for opening and for lateral extraction which makes it possible to move, if applicable, by pivoting or tilting, the bit inserted in the pocket from its position of axial or longitudinal insertion in the latter into a position, or position for transverse extraction, substantially perpendicular with respect to the axis of the pocket and in that the system consists of a cutout produced longitudinally, on the outer side of the bracelet, in the lateral wall of the pocket, from the edge of the receiving opening, by opening on the latter, toward the bottom of the pocket.

2. The device according to claim 1, wherein the bracelet comprises an outer side and an inner side forming the back side of the outer side and being intended to be in contact with the wrist, and wherein each holding cavity extends over the outer side.

3. The device according to claim 1, wherein the portions of the bracelet connecting two adjacent pockets have a smaller thickness and are resiliently deformable.

4. The device according to claim 1, wherein each holding cavity has an overall conical shape which widens toward the receiving opening of the cavity, or wherein each holding cavity consists of a first section integrating the receiving opening of the cavity and having an overall conical shape which widens toward the receiving opening of the cavity, and, furthermore, of a second section having a substantially cylindrical overall shape and axially extending the first section and integrating the bottom of the cavity.

5. The device according to claim 1, wherein the inner edge of each receiving opening is rounded.

6. The device according to claim 1, wherein each magnet is in the shape of a pellet or round platelet and is fastened in one of the holding cavities extending substantially perpendicularly to the axis of the latter in such a manner as to form the bottom.

7. The device according to claim 6, wherein each holding cavity is integrated in the bracelet by being formed by one of the pockets and in that each magnet is fastened in the corresponding holding cavity nesting at the bottom of the latter in a housing comprising a bottom and an inlet opening delimited by a re-entrant edge, which may or may not be continuous, and which is produced in the inner wall of the holding cavity, the re-enterant edge being resiliently deformable so as to allow the passage of the magnet which is immobilized axially in the housing between the bottom and the re-enterant edge of the latter.

8. The device according to claim 1, wherein each has a straight, round or conical shape or a combination of the shapes.

9. The device according to claim 8, wherein the cutout has an overall profile in the shape of a drop of water comprising successively, from the edge of the receiving opening, a slot or narrow part forming a portion for receiving and guiding the bit in the cutout during its tilting, then a broadened portion forming an opening for lateral extraction which is suitable for receiving the bit in the tilted state so as to position it in the position for transverse extraction.

10. The device according to claim 1, wherein the polymer material is a plastic material.

11. The device according to claim 10, wherein the plastic material is a natural or synthetic rubber.

* * * * *